US006816600B1

(12) United States Patent
Jakob et al.

(10) Patent No.: US 6,816,600 B1
(45) Date of Patent: Nov. 9, 2004

(54) REMOTE CONTROL FOR A HEARING AID, AND APPLICABLE HEARING AID

(75) Inventors: Andreas Jakob, Hombrechtikon (CH); François Marquis, Oron-le-Châtel (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/482,366

(22) Filed: Jan. 13, 2000

(30) Foreign Application Priority Data

Jan. 13, 2000 (WO) ..... PCT/CH00/00020

(51) Int. Cl.[7] ..... H04R 25/00
(52) U.S. Cl. ..... 381/315; 381/312; 455/41.1
(58) Field of Search ..... 340/826.69, 826.72, 340/825.72; 368/10; 455/66, 92, 344, 41.1, 41.2; 381/312, 315

(56) References Cited

U.S. PATENT DOCUMENTS 4,947,179 A 8/1990 Ganter et al.
4,947,432 A * 8/1990 Topholm ..... 381/68.2
5,144,599 A * 9/1992 Blaich et al. ..... 368/10
5,578,999 A * 11/1996 Matsuzawa et al. ... 340/825.22
5,721,783 A * 2/1998 Anderson ..... 381/328
5,798,984 A * 8/1998 Koch ..... 368/10
5,824,022 A * 10/1998 Zilberman et al. ..... 607/57
5,907,522 A * 5/1999 Teodoridis et al. ..... 368/10
6,411,569 B1 * 6/2002 Megner et al. ..... 368/10

FOREIGN PATENT DOCUMENTS

DE 36 42 828 A 8/1987
DE 41 09 840 A 10/1992
EP 0 298 323 A 1/1989
EP 0 339 482 A 11/1989

* cited by examiner

*Primary Examiner*—Curtis Kuntz
*Assistant Examiner*—Brian Ensey
(74) *Attorney, Agent, or Firm*—Pearne & Gordon LLP

(57) ABSTRACT

A remote control of a hearing aid is integrated into a case (1) of a wrist watch with wristband (3). A coil antenna (5) of the remote control is designed to generate a field similar to that of a dipole (P) which substantially runs in the direction of the wristband (3). The wrist watch remote control for the hearing aid provides a reliable communication link that is assured for the in-situ hearing aid.

18 Claims, 2 Drawing Sheets

REMOTE CONTROL FOR A HEARING AID, AND APPLICABLE HEARING AID

BACKGROUND OF THE INVENTION

The invention relates to a remote control for a hearing aid and to a hearing aid that is remotely controlled.

Inductive hearing-aid controls have long been known, for instance from the Swiss patent 670,349. They constitute one more device the individual must keep nearby to act as required on their hearing aid operation. It is far from easy for everybody to carry out in public remote hearing aid control in an unobtrusive manner, because thereby disclosing the use of a hearing aid against his desire to hide such a fact.

Another problem arises in that the remote control may not be at hand precisely when needed.

SUMMARY OF THE INVENTION

The present invention is directed toward solving the deficiencies in the art.

An inductive remote control conventionally comprises a transmission unit acting at its output on a coil which is the transmitter antenna. A control unit is externally fed with control signals and transmits, at its output side, at least part of the hearing-aid control signals to the transmission unit. In accordance with the present invention, such a transmission unit, coil, control device and a plain or rechargeable battery are integrated into a wrist watch. The coil is designed such that it will generate a magnetic field as would be attained from a magnetic dipole parallel to the direction of the wrist band. As regards an analog watch, the direction corresponds to that subtended by the 6 o'clock and 12 o'clock markings on the watch dial.

The integration of remote controls into a wrist watch is described in U.S. Pat. No. 4,063,410; German patent 36 42 828 corresponding to U.S. Pat. No. 4,947,432 and in the European patent document 0,298,323.

The integration of the invention of an inductive remote control (using a coil as the transmitter antenna) into a wrist watch and to use this inductive remote control as the hearing-aid remote control additionally solves the problem in the conventional remote controls whereby no rules can be set regarding position. Also, frequently the communications link between the remote control and the hearing aid cannot be established or will be interrupted because of unfavorable relative positions at the time. As regards the remote control of the invention, on the other hand, the remote control, when being operated, is moved in position within a relatively narrow range of positions, in general in front of the torso of the operator, and as a result the communications link is substantially assured.

Considering present-day miniaturization of hearing aids and the endeavors to hide them as inconspicuously as possible within the ear zone, problems concerning reliability of transmission are easily solved in the procedure of the invention. The inductive remote controls, operating on electromagnetic field principles, must suffice at very low powers such that the operations entail no frequency-band restrictions or special permits as are known regarding higher radio transmission powers.

Within the scope of the present invention, optimal communications reliability between the remote control at the wrist watch and the hearing aid is attained, as already cited, provided that the coil generate a magnetic field approximately that of a magnetic dipole at the wrist watch, and in the case of an analog watch, in the 6 o'clock to 12 o'clock direction on the dial.

Though it might seem obvious to use such components as the highly stable reference oscillators anyway already present in the watch for chronometric purposes also for the integrated remote control function of the invention, this approach however is not followed in accordance with one preferred embodiment of the present invention. At least part of the components, namely the transmission unit, the coil, the control unit and the plain battery or rechargeable battery are integrated into the wrist watch as operational units independent of chronometric function. The invention, therefore, allows integration of the remote control into the wrist watch without significantly affecting the already known and mass-produced operational units driving the chronometric function. Accordingly, the present invention therefore offers higher flexibility in the mentioned integration into wrist watches of the most varied constructions.

Another preferred embodiment of the remote control of the present invention provides at least one manually driven input device at the wrist watch. The input device may be used to operate the control unit, to actuate switching to other operational modes, control commands for instance for loudness, directionality, frequency-filter characteristics etc. at the hearing aid. Obviously the invention easily allows substituting voice inputs instead of one or more input devices, or in addition to, several manually operated ones such as keys, capacitive touch sensors etc. at the wrist watch.

In a further preferred embodiment of the remote control of the invention, the watch is fitted with a visual display and/or an acoustic annunciator, preferably including an LED display. The display and/or annunciator is operationally connected to the control unit and/or the transmission unit, and confirms proper operation of the externally operable control unit, and/or displays that a preset charge on the plain or rechargeable battery of the remote control has been reached. As a result, the operator reliably knows on one hand that the input command signals have been properly recorded, as is especially important for key and/or voice inputs, and on the other hand will be informed when it is time to change the plain battery or to recharge the rechargeable one.

In another preferred embodiment of the remote control of the invention, the transmission unit generates an amplitude-modulated (AM) or frequency-modulated (FM) signal of a center frequency f of a given frequency range, where $$10\ \text{kHz} \leqq f \leqq 100\ \text{kHz},$$

preferably $20\ \text{kHz} \leqq f \leqq 60\ \text{kHz}$ and more preferably $35\ \text{kHz} \leqq f \leqq 45\ \text{kHz}$.

Even though, as already specified, it is easily feasible to generate the transmission field of the invention by superposing the fields from several coils, in a preferred embodiment the coil system is a linear coil. The linear coil is preferably a coil wound over a ferrite core that is integrated into the watch. The coil has an axial direction parallel to the direction of the wrist band, that is parallel to the direction of the 6 to 12 o'clock line of an analog watch.

Preferably, at least the plain battery or the rechargeable battery of the remote control is a Li-ion battery unit which, where called for, may also be used to drive the chronometer proper.

Further, at least one hearing aid is associated with a remote control and a receiver tuned to the transmission unit of the remote control is present in at least one hearing aid.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figure 1:
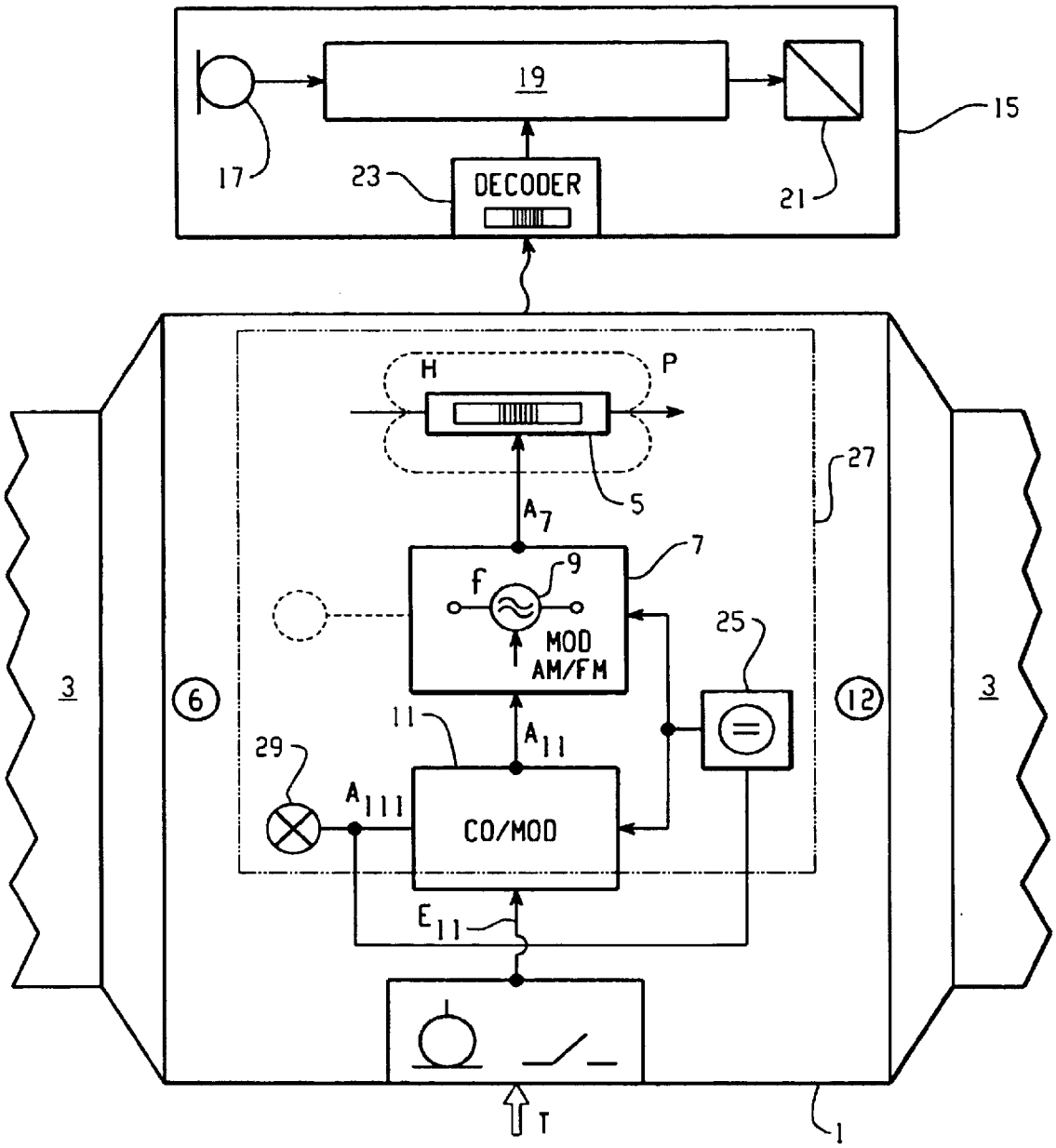
FIG. 1 shows schematically and in simplified manner a signal-flow block-diagram of the remote control of the invention and a hearing aid it drives, which together represent a set of the invention consisting of the hearing aid and the remote control, and FIG. 2 schematically shows the communication field link of a remote control and a hearing aid, each in-situ.

FIG. 1 is a schematic in the form of a signal-flow block diagram of a remote control of the invention, jointly with a hearing aid, and together forming a set of hearing aid and remote control of the invention.

An inductive remote control of the invention is integrated into a case 1 of a wrist watch with a wristband 3. This remote control includes a transmitter antenna 5 preferably constituted by a coil wound on a linear and, preferably, ferrite core. The transmitter antenna 5 generates a transmitted magnetic field H substantially like a magnetic dipole P pointing in the direction P of the wristband 3 as shown in FIG. 1, that is, in the case of an analog watch, in the direction of the 6-o'clock to the 12 o'clock ciphers.

The antenna 5 is operationally connected to the output $A_7$ of a transmission unit 7 which, as diagrammatically indicated, includes an AM or FM modulated transmitter oscillator 9. The modulation at the transmitter oscillator 9 takes place at a center frequency f in the range of 10 to 100 kHz, preferably in the range between 20 and 60 kHz, and more preferably in the range between 35 and 45 kHz. Preferably again, the transmitted oscillator is frequency modulated, preferably to two or more predetermined and fixed frequency values.

At the input side, the transmission unit 7 is operationally connected to the output $A_{11}$ of a control unit 11 functioning as a coding and modulating stage. The output $A_{11}$ of the control unit 11 is also operationally connected to the modulation input MOD of the transmitter oscillator 9. Control signals T are fed externally and as already mentioned manually or in voice mode to the input $E_{11}$ of the control unit 11 by means of an input device 13 comprising one or more manually operable input elements such as keys and/or an input microphone for voice input. The control unit 11 codes the input control signals and generates at its output modulation signals for the transmission unit 7 which, in turn, and through the antenna 5 transmits the corresponding control commands to a hearing aid 15. The hearing aid 15, which is fitted with a microphone 17, a signal-processing unit 19 and, at the output side, with an electromechanical converter 21, also comprises a receiver 23. The receiver is tuned to the transmitter antenna system 7, 5 at the wrist watch.

The receiver 23 fitted with the decoder decodes the received control commands and feeds them in a compatible format to the signal processing unit 19 of the hearing aid 15.

The electrically active components of the remote control integrated into the wrist watch are powered by a power supply 25, such as a plain battery or by a rechargeable battery, the latter preferably being a Li-ion battery.

FIG. 1 also shows by dashed lines the operational chronometric unit 27 of the wrist watch. The remote control of the invention, which comprises the components 5, 7, 11, 13 and 25, preferably is independent of the chronometric unit 27. If called for, only the plain battery and the rechargeable battery 25 are used to electrically feed the chronometric unit 27.

By means of an output $A_{111}$, the control unit acts acoustically on an annunciator and/or optically on a display 29.

In a preferred mode and as shown in FIG. 1, this display includes an optical device, preferably an LED device.

In particular, the display 29 displays when the control unit 11 has received a validated control signal from the input device 13. Accordingly, this display 29 confirms that such a signal was received. Obviously too, such a display can be alternatively or, in a complementary manner, be operationally connected to the transmission unit 7, as indicated in dashed lines, to confirm that a valid command signal was generated and transmitted through the antenna 5 to the hearing aid. The display 29 furthermore indicates, preferably, the operational or charge status of the power supply 25.

Figure 2:
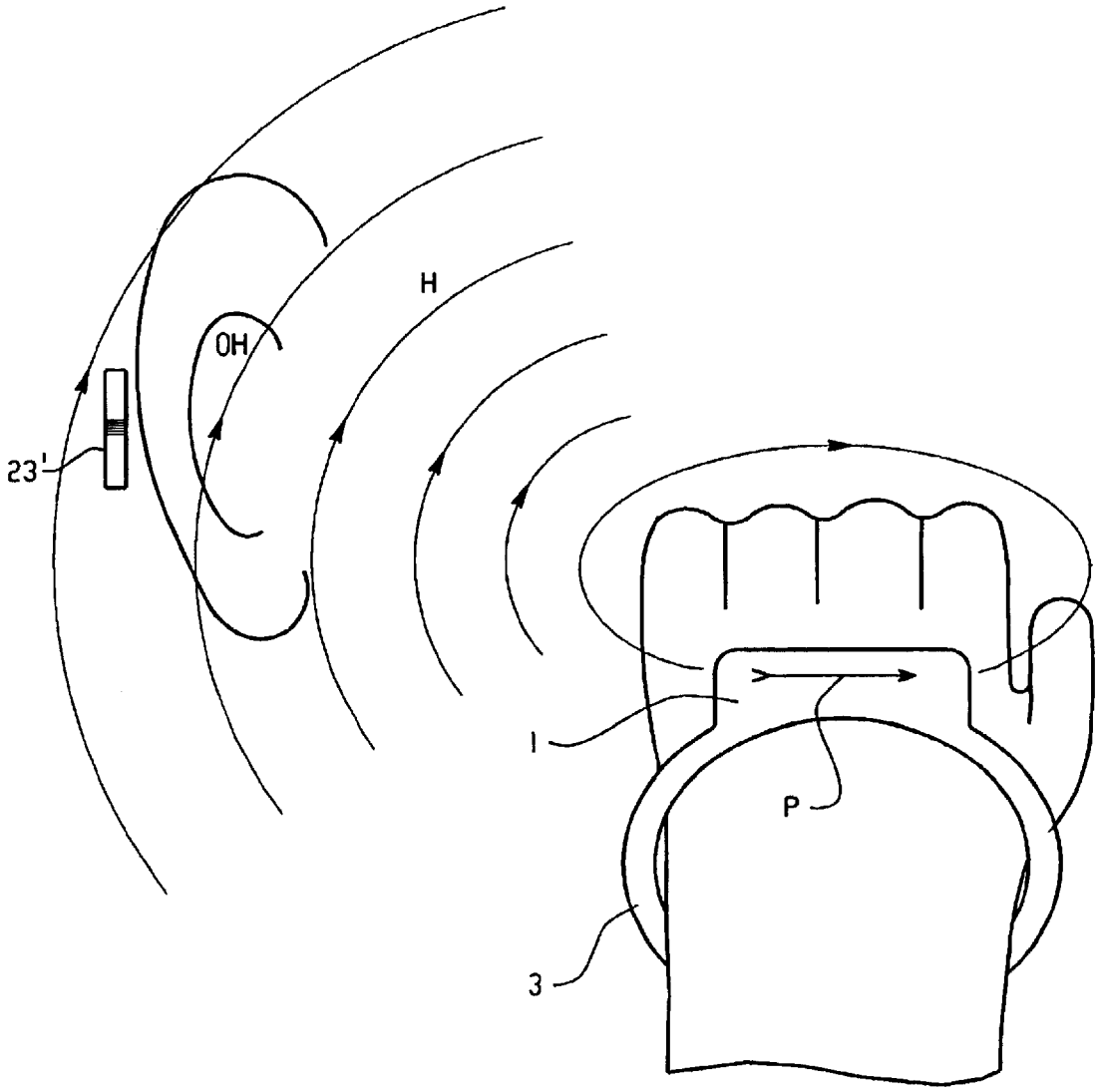

FIG. 2 schematically shows the wrist of a person together with the wristband 3 and the case 1 of a wrist watch with an integrated remote control of the invention. P indicates the magnetic dipole of the coil 5 of FIG. 1. When the wrist is kept in front of the torso to operate the remote control at the wrist watch, then the position of the dipole P relative to the person's ear and her hearing aid illustratively fitted with the receiving coil 23' is as shown in FIG. 2. If the transmitter dipole P assumes the position of the invention in the watch, then the transmitted field H is optimally directed with respect to the ear OH, where it is optimally received, for instance, by the receiving coil 23' of a behind-the-ear hearing aid. In this manner link reliability is considerably enhanced and will remain substantially insensitive to changes in the position of the wrist or the watch within the typical range of variations in which convenient observation of the watch position is assured.

What is claimed is:

1. A remote control comprising a transmission unit operationally connected at its output to an inductive transmitter antenna, a control unit, the output thereof being operationally connected to an input of said transmission unit, and a a power supply powering said transmission unit and said control unit, wherein said transmitter antenna comprises a coil arrangement;

said coil arrangement, said control unit said transmission unit and said power supply are integrated into a case of a wristwatch;

and said coil arrangement generates a magnetic field in response to said control unit at least approximately equal to a magnetic dipole with a dipole direction parallel to the case and in a direction of a wristband of said wristwatch as considered in a top view upon said case.

2. The remote control as claimed in claim 1, wherein at least part of the components of the group of components consisting of the transmission unit, coil arrangement, control unit and powers supply are integrated into the wristwatch to operate independently of a chronometric function of said wristwatch.

3. The remote control as claimed in claim 1, wherein the wristwatch comprises at least one manually operated input device to drive the control unit.

4. The remote control as claimed in claim 1, wherein a visual display is provided by the wristwatch, said display being operationally connected with the control unit and/or the transmission unit.

5. The remote control as claimed in claim 1, wherein the transmission unit transmits a modulated signal at a center frequency f, wherein:

$$10\ \text{kHz} \leqq f \leqq 100\ \text{kHz}.$$

6. The remote control as claimed in claim 1, wherein the coil arrangement is a linear coil.

7. The remote control as claimed in claim 1, wherein said power supply is a Li-ion battery.

8. An apparatus with a remote control and a receiver device, wherein the remote control is designed as claimed in claim 1 and wherein the receiver device is tuned to the transmission unit of the remote control.

9. The remote control as claimed in claim 5, wherein the center frequency f is:

$$20\ \text{kHz} \leqq f \leqq 60\ \text{kHz}.$$

10. The remote control as claimed in claim 5, wherein the center frequency f is:

$$35\ \text{kHz} \leqq f \leqq 45\ \text{kHz}.$$

11. The remote control as claimed in claim 6, wherein the linear coil is a coil wound on a ferrite core.

12. The remote control as in claim 1, wherein the remote control is a hearing device remote control.

13. The remote control as in claim 1, wherein the remote control is a hearing aid remote control.

14. The apparatus as in claim 8, wherein the apparatus is a hearing device.

15. The apparatus as in claim 8, wherein the apparatus is a hearing aid device.

16. The remote control as claimed in claim 4, wherein said display is an LED display.

17. The remote control as claimed in claim 4, wherein said display indicates proper operation of said control unit.

18. The remote control as claimed in claim 4, wherein said display displays the status of said power supply.

* * * * *

UNITED STATES PATENT AND TRADEMARK OFFICE

CERTIFICATE OF CORRECTION

PATENT NO. : 6,816,600 B1
DATED : November 9, 2004
INVENTOR(S) : Andreas Jakob et al.

It is certified that error appears in the above-identified patent and that said Letters Patent is hereby corrected as shown below:

Column 4,
Line 35-36, please delete "and a a power supply", and insert therefor -- and a power supply --.

Signed and Sealed this

Twenty-sixth Day of April, 2005

JON W. DUDAS
*Director of the United States Patent and Trademark Office*